US007804408B2

(12) United States Patent
Kolton et al.

(10) Patent No.: US 7,804,408 B2
(45) Date of Patent: Sep. 28, 2010

(54) ELECTRONIC TAG HOUSING HAVING SHRINK WRAP SUPPORT

(75) Inventors: Chester Kolton, Westfield, NJ (US); Michael Norman, East Brunswick, NJ (US); Robert Whittemore, Montgomery, NY (US)

(73) Assignee: B & G International, Inc., Newark, NJ (US)

( * ) Notice: Subject to any disclaimer, the term of this patent is extended or adjusted under 35 U.S.C. 154(b) by 513 days.

(21) Appl. No.: 11/804,445

(22) Filed: May 18, 2007

(65) Prior Publication Data

US 2007/0273535 A1 Nov. 29, 2007

Related U.S. Application Data

(60) Provisional application No. 60/801,271, filed on May 18, 2006, provisional application No. 60/834,998, filed on Aug. 2, 2006, provisional application No. 60/856,989, filed on Nov. 6, 2006.

(51) Int. Cl.

| | |
|---|---|
| ***G08B 13/14*** | (2006.01) |
| ***G09F 3/10*** | (2006.01) |
| ***G09F 3/00*** | (2006.01) |
| ***G09F 3/08*** | (2006.01) |

(52) U.S. Cl. ..... 340/572.1; 340/572.4; 340/572.7; 340/572.8; 340/572.9; 340/568.1; 40/299.01; 40/312; 40/662; 40/668

(58) Field of Classification Search ..... 340/572.1, 340/572.9, 568.1, 568.8, 572.8; 40/299.01, 40/312, 662, 668

See application file for complete search history.

(56) References Cited

U.S. PATENT DOCUMENTS

| | | | | |
|---|---|---|---|---|
| 6,188,320 | B1 | 2/2001 | Kolton et al. | |
| 6,304,184 | B1 | 10/2001 | Kolton et al. | |
| 6,317,046 | B1 * | 11/2001 | Fresnel et al. | 340/572.9 |
| 6,330,758 | B1 | 12/2001 | Feibelman | |
| 6,433,686 | B1 * | 8/2002 | Feibelman | 340/572.8 |
| 6,518,888 | B1 * | 2/2003 | Kolton et al. | 340/572.8 |
| 6,624,753 | B2 | 9/2003 | Elston | |
| 6,933,847 | B2 | 8/2005 | Feibelman | |

* cited by examiner

*Primary Examiner*—Benjamin C Lee
*Assistant Examiner*—Lam P Pham
(74) *Attorney, Agent, or Firm*—Hoffman & Baron, LLP

(57) ABSTRACT

The present invention provides for an electronic tag housing used to support electronic tags to an article with a shrink wrap tube. The present invention provides an electronic tag assembly, including a housing, having a base and a cover attachable to the base. The housing includes a cavity for supporting an electronic tag. A heat shrinkable tube is supported by the housing between the cover and attachable base.

8 Claims, 10 Drawing Sheets

ELECTRONIC TAG HOUSING HAVING SHRINK WRAP SUPPORT

CROSS-REFERENCE TO RELATED APPLICATION

This application claims priority to U.S. Patent Application Ser. No. 60/801,271, filed on May 18, 2006; U.S. Patent Application Serial No. 60/834,998, filed on Aug. 2, 2006; U.S. Patent Application Ser. No. 60/856,989 filed on Nov. 6, 2006, all of which is incorporated herein by reference.

FIELD OF THE INVENTION

The present invention is relates to an electronic tag housing used to support electronic tags. More particularly, the present invention relates to an electronic tag housing which may be supported to an article with a shrink wrap tube.

BACKGROUND OF THE INVENTION

It is widely known to use electronic tags for various purposes. Such electronic tags may include article surveillance (EAS) tags as well as radio frequency identification (RFID) tags. RFID tags are commonly used to track the articles to which they are attached for purposes of tracking sales and shipment of the article. EAS tags may be used to provide theft deterrents. These tags are used in combination with an alarm system which monitors undesired movement of the article containing the EAS tag.

Housings have been developed which accommodate the electronic tag and which attach the tag to the desired article. Clearly, especially with the case of article surveillance tags to deter theft, it is necessary that the tag be securely supported to the article in such a manner where it remains with the article until the time of purchase. The art has seen a number of tag housings which secure the tag to the article in a manner which thwarts the unauthorized removal of the tag from the housing. However, many of these tags become difficult to remove even by authorized personnel. For example, at the point of sale, the sales person must use specialized tools and equipment to safely remove the tag housing from the article once it has been purchased.

One housing which supports an article surveillance tag to products such as eyeglasses is shown and described in U.S. Pat. No. 6,330,758. The product described therein employs a shrink wrap tube which is attachable to the tag housing. The tube may be slid over the temple arm piece of the eyeglass frame an then shrunk thereon by application of heat. At the point of purchase, the tag housing may be removed by cutting the shrink wrap tube from the article.

The product described in the above-referenced patent, while adequate for its intended purpose, is not without disadvantages. For example, the shrink wrap tube must be inserted within a slot formed on the housing. Such arrangement does not securely attach the tube to the housing prior to shrinking the tube on the article. Furthermore, since the shrink wrap tube is ultimately shrunk onto the article itself, cutting the shrink wrap tube from the article without damaging the article is difficult.

It is, therefore, desirable to provide an improved tag housing which supports an electronic tag and a shrink wrap tube to an article where the tube is securely supported on the housing and can be removed by authorized personnel in a cost effective and safe manner.

SUMMARY OF THE INVENTION

The present invention provides an electronic tag assembly, including a housing, having a base and a cover attachable to the base. The housing includes a cavity for supporting an electronic tag. A heat shrinkable tube is supported by the housing between the cover and attachable base.

The base may include a planar portion defining the cavity. The base may also include a longitudinal extending portion underlying the heat shrinkable tube. The extending portion includes a longitudinal depression defining an access passage beneath the tube.

The cover may also support an indicia bearing structure. The indicia bearing structure may be separately attached to the cover and rotatable therewith. The indicia bearing structure may include the cavity for supporting the electronic tag.

The base may also include an elastomeric element in facing opposition to a portion of the tube, thereby defining an insertion channel for insertably receiving the article to which the housing is attached. The tube is shrinkable upon application of heat to retentively attach to the article and place the article in resilient engagement with the elastomeric element.

DETAILED DESCRIPTION OF THE PREFERRED EMBODIMENTS

Figure 1:
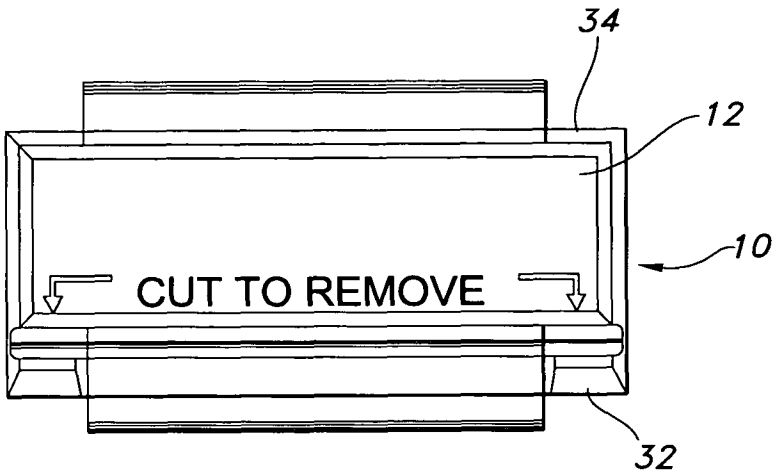
FIGS. 1-9 show a first embodiment of an electronic tag assembly of the present invention including a housing supporting an electronic tag and a heat shrinkable tube.
Figure 2:
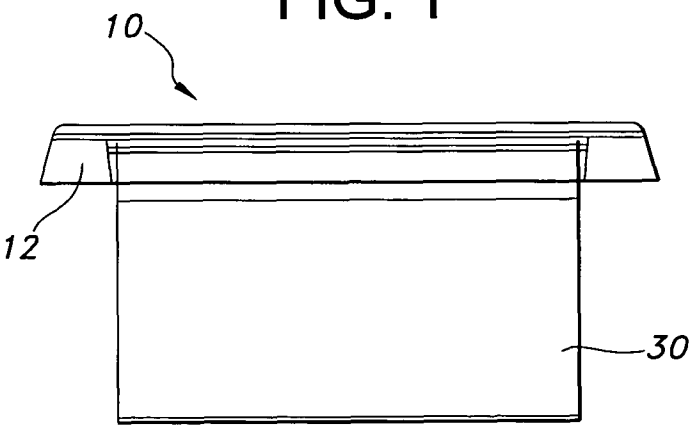
Figure 3:
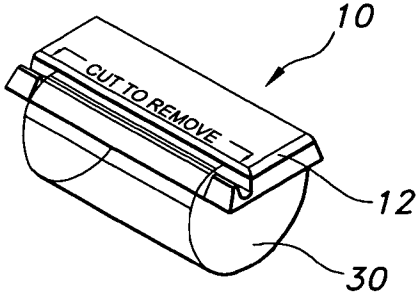
Figure 4:
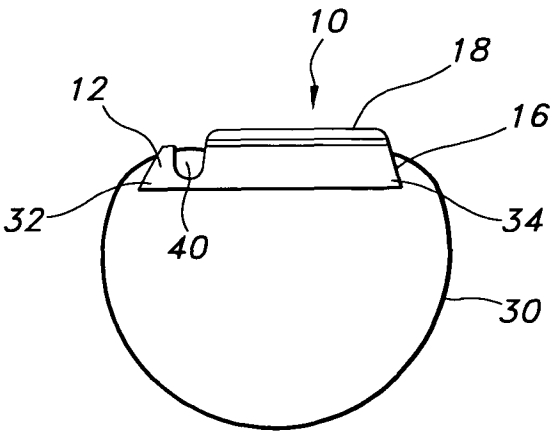

The present invention provides a tag housing assembly including a housing which supports an electronic tag, for example, an electronic article surveillance (EAS) tag or radio frequency identification (RFID) tag. The housing is attachable to an article so as to maintain the tag with the article to track shipment, purchase and/or to provide theft deterrence.

The housing of the present invention supports a heat shrinkable tube which may be placed over an article or portion of an article, and shrunk thereabout to secure the housing to the article. The heat shrinkable tube may be severed to effect removal of the housing from the article. While the housing may be used in combination with any desired article, the present invention is particularly useful with articles have elongate segments such as eyeglasses and paint brushes.

Referring to FIGS. 1-9, one embodiment of the tag housing assembly of the present invention is shown. Tag housing assembly 10 includes a tag housing 12 and an electronic tag 14 supported by the housing 12.

In the present illustrative embodiment, tag 14 is an elongate generally rectangular planar member which may function as an EAS tag or an RFID tag as is well known in the art. Other configurations and types of electronic tags are also contemplated within the scope of the present invention.

Tag housing 12 is generally an elongate planar shaped two-piece member including a base 16 and cover 18. The base 16 may include an elongate cavity 20 formed therein. Cavity 20 is configured to accommodate tag 14 therein.

Cover 18 is positionable over base 16 and is attached thereto to cover and enclose the tag 14 within the cavity 20 of base 16. The cover 18 may be secured to base 16 by any well known attachment technique such as friction fit, adhesive, ultrasonic welding and the like.

Figure 7:
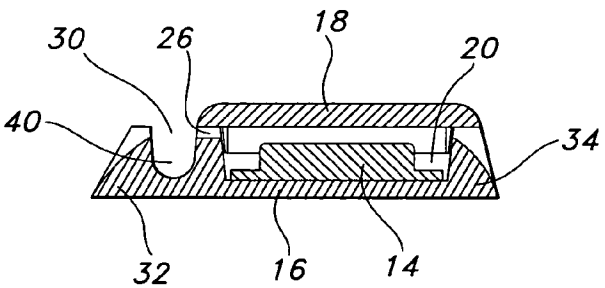
Figure 6:
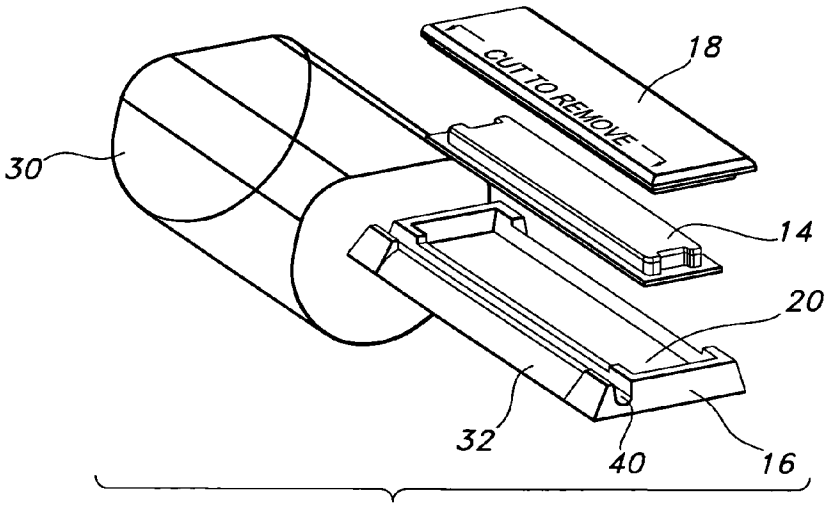
Figure 5:
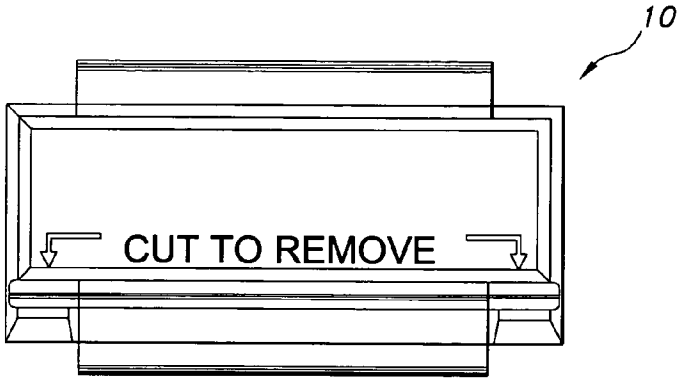
Figure 8:
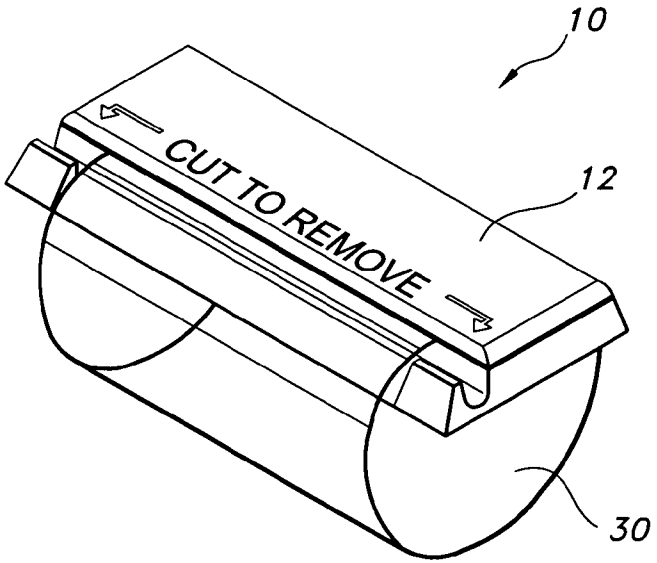
Figure 9:
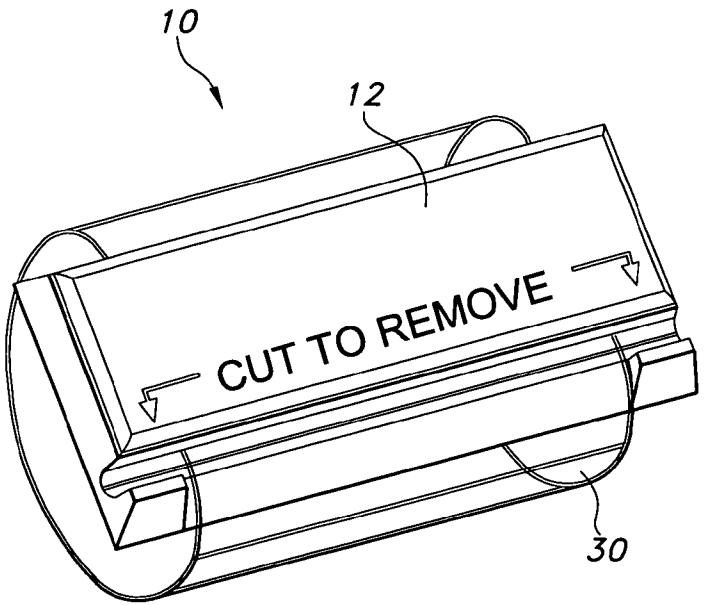
Figure 13:
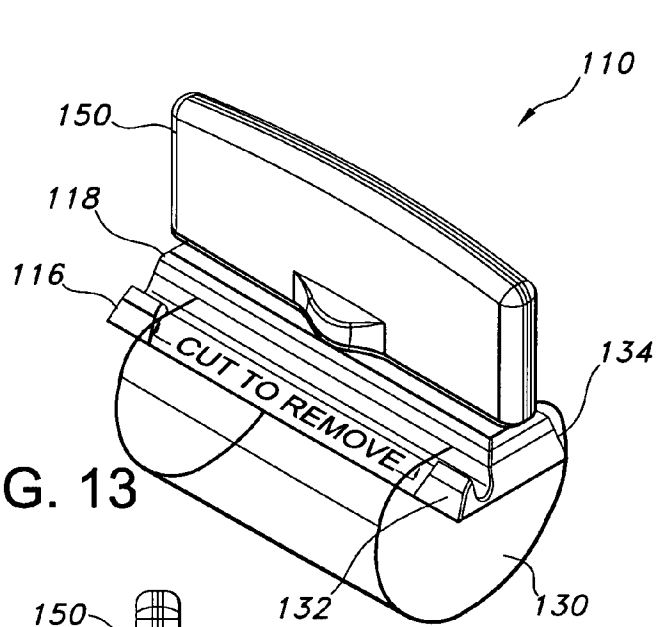
FIGS. 10-15 show a further embodiment of an electronic tag assembly of the present invention including a swivel housing supporting an electronic tag and a heat shrinkable tube.
Figure 12:
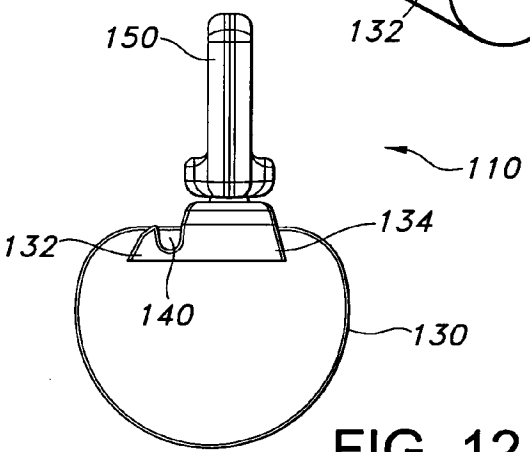
Figure 10:
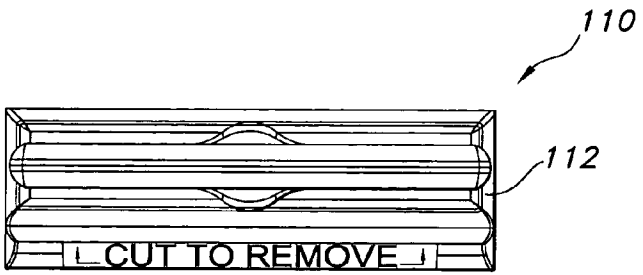
Figure 11:
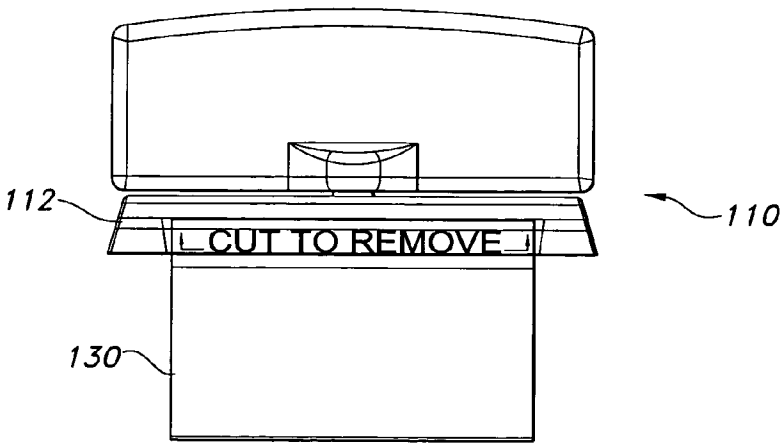

As more fully shown in FIGS. 6 and 7, base 16 includes a pair of elongate opposed recessed side walls 22 and 24 on either side of cavity 20. Recessed side walls form a gap 26 between cover 18 and base 16 over cavity 20. The gap 26 supports a heat shrunk tube 30 between cover 18 and base 16 over cavity 20 and tag 12 supported therein.

The tube 30 is an elongate member having a tubular wall. The tube may be formed of a wide variety of heat activated materials, one material being a polyethylene material, which is sold under the trademark TYVEK. The tube 30 is heat activated so as to shrink upon application of heat. The tube 30 is designed to receive an article or portion of an article to which the tag housing is to be secured, such that upon application of heat the tube 30 will shrink about the article securing the tag housing 12 to the article.

To assure that the shrunk tube 30 conforms to the article placed therein upon heat shrinking, the base 16 includes a pair of opposed longitudinal ends 32 and 34 which are downwardly curved. Edges 32 and 34 allow the shrunk tube 30 to conform to the shape of the article placed therein by directing the tube downward from base 16.

As the heat shrink tube 30 will shrink to conform to the article which has been placed therein, the tag housing will be difficult to remove from the article after heat shrinking. While such securement is beneficial to prevent unauthorized removal of the tag housing from the article, it makes authorized removal inconvenient without damaging the article.

The present invention further provides a technique for allowing authorized personnel to remove the tag housing from the article after the tube has been shrunk onto the article.

Referring to FIGS. 4-7, base 16 includes inward of curved edge 32, a longitudinal upward opening U-shaped depression 40 therealong. Depression 40 underlies tube 30 and forms a cut slot. The cut slot formed by depression 40 defines a passageway for insertion of scissors or the blade of a cutting tool so as to cut the shrunk tube 30 thereby severing the tag housing from the article. The depression 40 allows such insertion of a cutting tool thereinto without damaging contact with the article.

A further embodiment of the present invention is shown with respect to FIGS. 10-15. Tag housing assembly 110 is substantially similar to tag housing 10 described above. For simplicity of description, 100 has been added to similar reference numerals.

Tag housing assembly 110 includes a housing 112 including a base 116 and cover 118. A heat shrinkable tube 130 is supported between the base 116 and cover 118 in a manner similar to that described above. The base 116 defines opposed curved edges 132 and 134 to direct the shrunk tube about an article inserted therein. Similarly, base 116 includes a U-shaped depression 140 underlying tube 130 so as to facilitate removal of the tag housing from the article.

In the present illustrative embodiment, cover 118 supports a two-piece subassembly 150 which is attached thereto. Subassembly 150 is an elongate generally planar member formed of two mating half portions 152 and 154. The portions define therebetween a cavity 155 which supports tag 114 therein.

The subassembly 150 includes opposed planar surfaces 151 and 153 which are used as indicia bearing surface to provide information representing the article to which the tag housing 12 is attached. Such information may include product identification, features, trademarks, as well as pricing and bar code information.

A further feature of the present embodiment is that the subassembly 150 may be attached to cover 118 so as to rotate or swivel thereabout.

Figure 15:
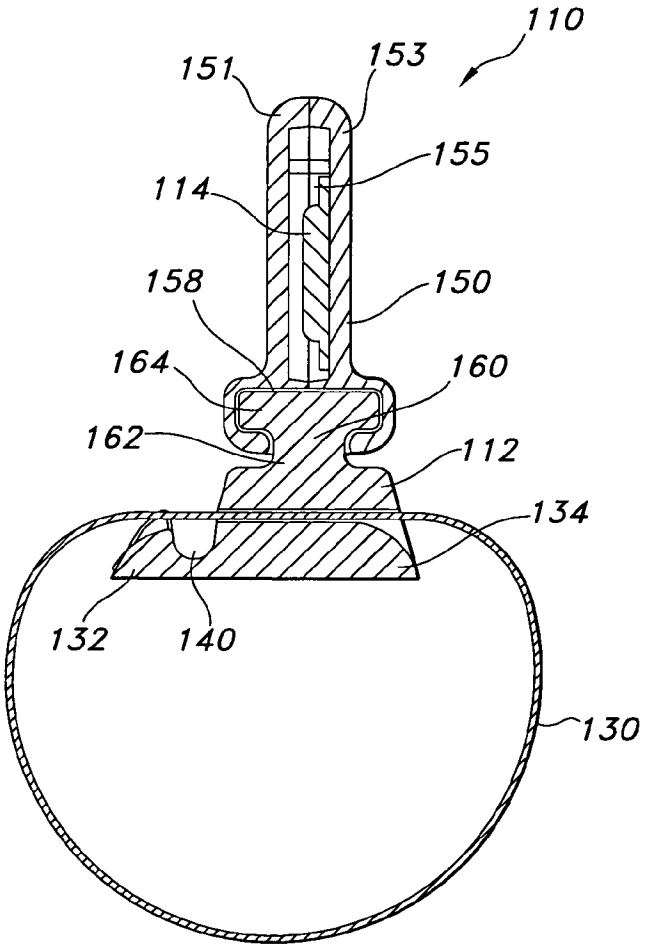
Figure 14:
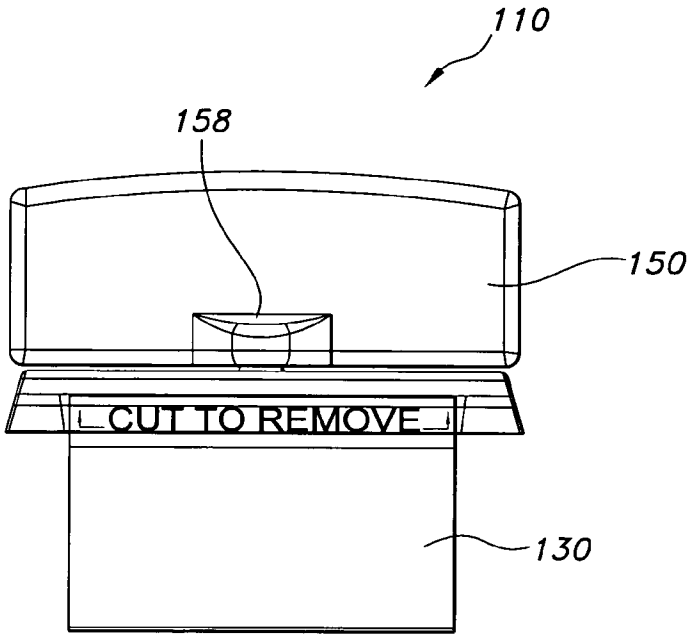
Figure 16:
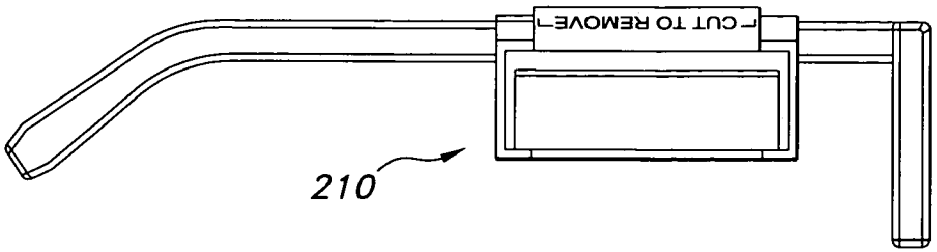
FIGS. 16-25 show a still further embodiment of the electronic tag assembly of the present invention including an elastomeric attachment surface.
Figure 17:
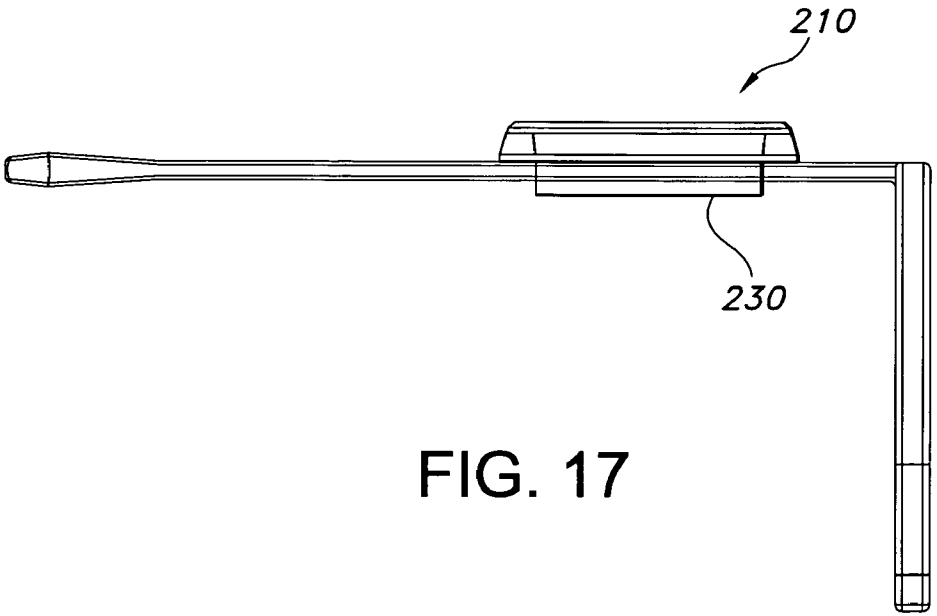
Figure 18:
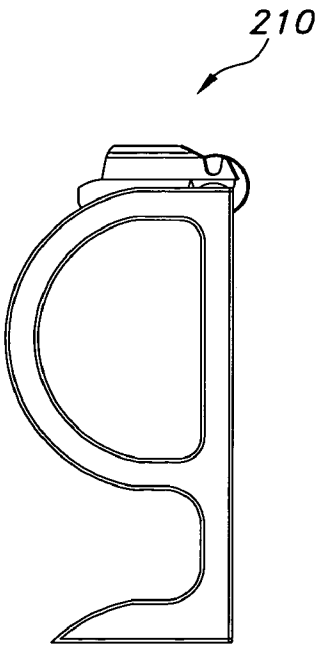
Figure 19:
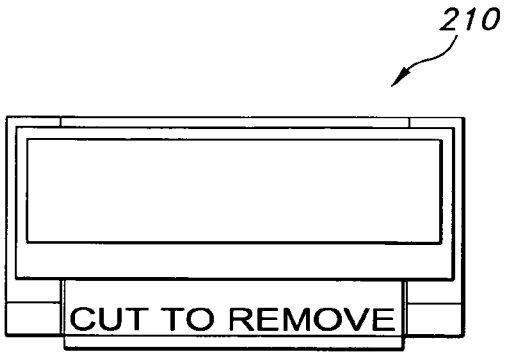
Figure 22:
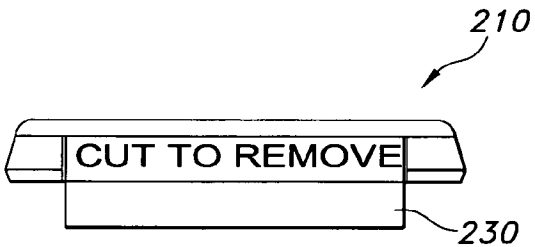
Figure 20:
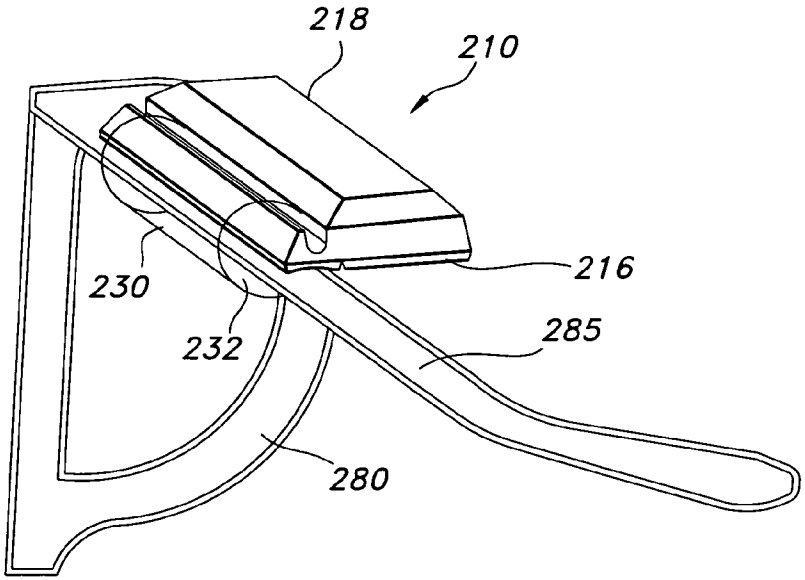
Figure 21:
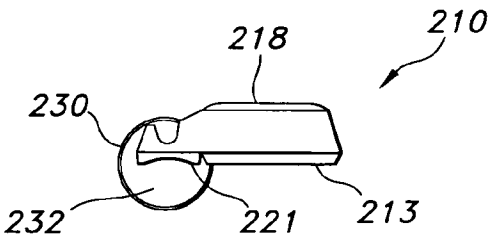
Figure 25:
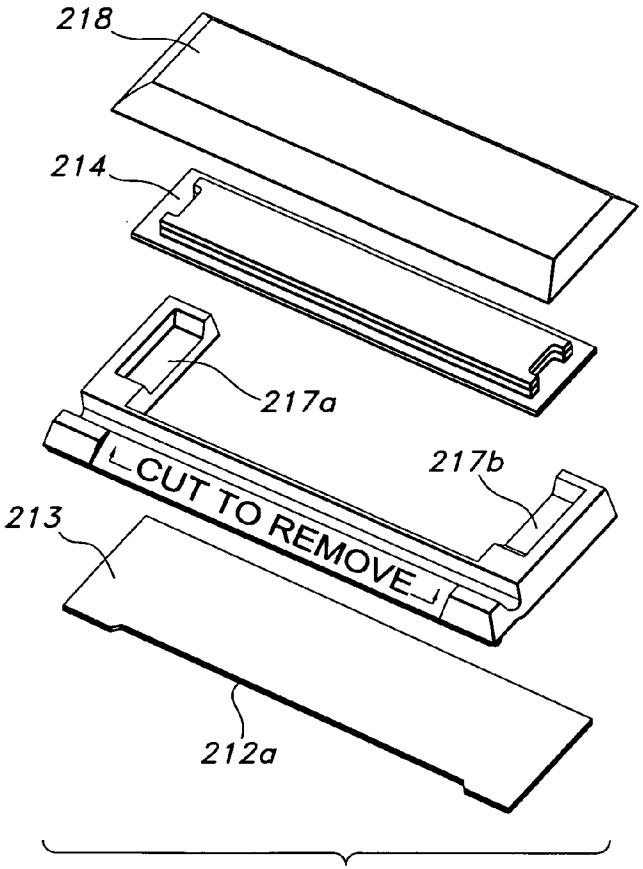
Figure 23:
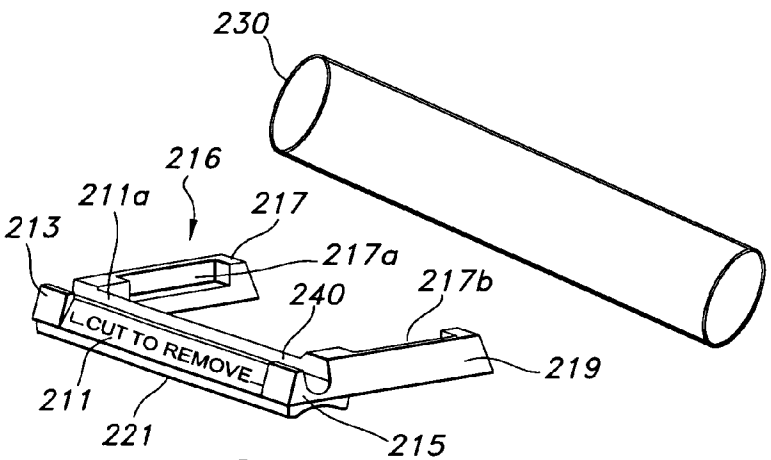
Figure 24:
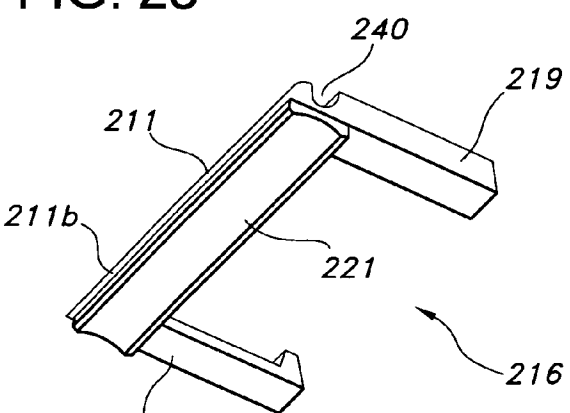
Figure 26:
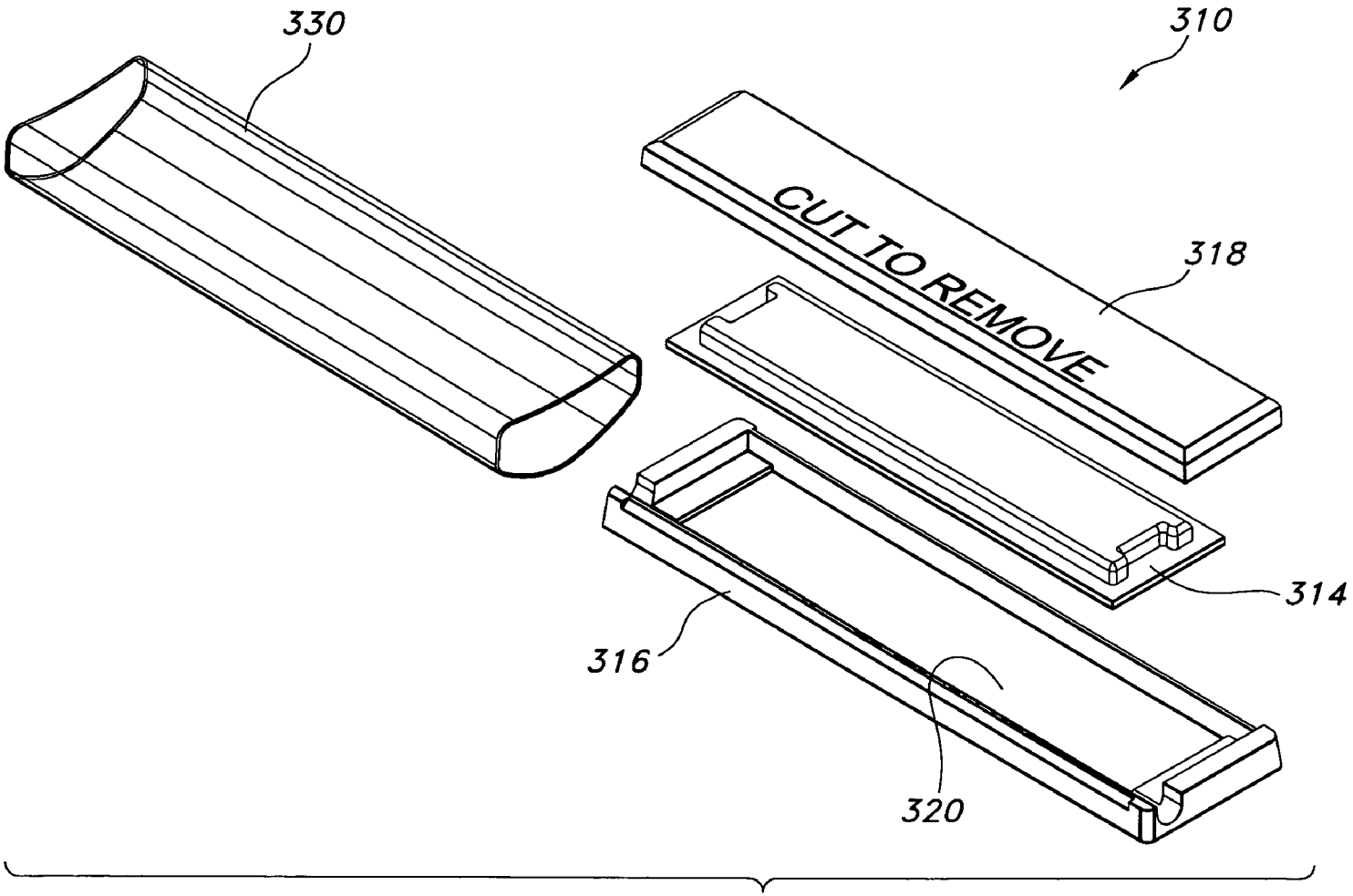
FIG. 26 is an exploded perspective view of an additional embodiment of the electronic tag assembly of the present invention.
Figure 28:
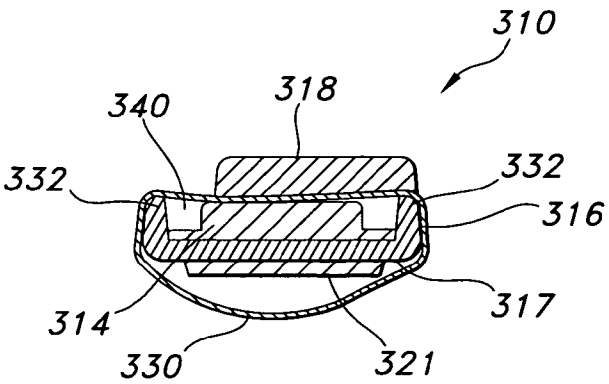
FIG. 28 is a sectional showing of the electronic tag assembly of FIG. 26.

As particularly shown in FIG. 15, cover 118 includes a centrally located upwardly extended projection 160. Projection 160 has a central shaft 162 and a bulbous end 164 distal from the body of cover 118.

In order to attach to cover 118, subassembly 150 includes a centrally located socket 158 which mates with bulbous end 164 of cover 118 to form a ball and socket connection. Such connection allows the subassembly to rotate or swivel with respect to cover 118.

A still further embodiment of the present invention is shown with respect to FIGS. 16-25. Tag housing assembly 210 is similar to tag housing assembly 10 described above. For simplicity of description, 200 has been added to similar reference numerals.

Tag housing assembly 210 includes a housing 212 including a base 216, a cover 218 and a bottom closure 213. A heat shrinkable tube 230 is supported between based 216 and cover 218 as will be described hereinbelow. The tube 230 is positioned to define an insertion channel 232 for insertably receiving an article such as the elongate temple piece 285 of eyeglasses 280.

A shown in the drawings, base 216 includes an elongate member 211 having opposed ends 213 and 215. A pair of rails 217 and 219 extend, respectively, from ends 213 and 215. The elongate member 211 includes an upper surface **211*a* and an opposed lower surface 211*b***.

The elongate member 211 supports tube 230 thereabout with the tube positioned against upper surface **211*a*. The upper surface 211*a* includes a U-shaped depression 240, as described above with respect to FIGS. 1-9, so as to facilitate removal of the tube 230 without damage from temple piece 285** once it has been heat shrunk therearound.

The lower surface **211*b* of elongate member 211 supports therealong an elastomeric pad 221. Pad 221 is an elongate member which is co-extensive with the lower surface 211*b* of elongate member 211. The elastomeric pad 221 is preferably formed of a soft thermoplastic elastomer (TPE) or similar resilient material. The pad 221 is attached to the lower side 211*b* by overmolding the pad thereto during manufacture. As will be described hereinbelow, the TPE pad 221 helps secure tag housing assembly 210 to the temple piece 285 of eyeglasses 280**.

The rails 217 and 219 support thereabout the electronic tag 214. The rails each include an indented portion **217*a* and 219*a***, respectively, which seats and supports the opposed ends of the rectangular tag.

Bottom closure 213 is a planar member and is attached to base 216 across the rails 217 and 218. The bottom closure 213 has cut out **212*a* which forms a space with elongate member 211 to allow accommodation of the tube 230** therebetween.

Cover 218 is supported by base 216 on its upper face over elongate tag 214. Cover 218 is also positioned to engage and secure tube 230 which extends around elongate member 211 of base 216.

As with the above embodiments, the tube 226 is positioned between the elongate member of base 216 and cover 218. The cover 218, base 216, and bottom closure 213 are then secured together, preferably by ultrasonic welding to secure the tube to housing 212 and enclose the tag 214 between the cover and bottom closure.

The embodiment described in FIGS. 16-25 operates in the following manner.

The tag housing assembly 210, including the tube 230, and electronic tag 214 is placed over, for example, the temple piece 285 of eyeglass 280 by inserting the temple piece into the channel defined by the tube 230.

The shrink tube 230 is then shrunk onto the temple piece 285 by applying heat to the tube 230. Shrinking of the tube forces the temple piece 285 in resilient engagement with the TPE pad 221. Such resilient engagement provides a more secure attachment by conforming the TPE pad and the shrink tube to the temple piece. Moreover, the TPE material provides a frictional surface which resists sliding of the assembly along the temple arm piece. In that regard, the TPE material has a high coefficient of friction.

As with the above embodiment previously described, after purchase, the tag housing assembly may be removed by cutting the shrink tube at the U-shaped depression.

A further embodiment of the tag housing assembly of the present invention is shown in FIGS. 26-29. The tag housing assembly 310 is substantially similar to tag housing assembly 10 shown with reference to FIGS. 1-9 above. Tag housing assembly 310 includes a tag housing 312 and an electronic tag 314 supported by the housing 312.

Tag 314 is an elongate generally rectangular planar member of the type described above. However, it is contemplated that other shapes of electronic tags may also be employed. Tag housing 312 is generally an elongate planar shaped multi-component member including a base 316 and a cover 318. The base 316 may include an elongate cavity 320 formed therein. The cavity 320 is configured to accommodate tag 314 therein. The cover 318 is positionable over the base and is attached thereto to cover and enclose the tag 318 within the cavity 320 of base 316. The cover 318 may be secured to the base 316 by an well known attachment techniques such a friction fit, adhesive, ultrasonic welding or the like.

Heat shrink tubing 330 is supported around base 316 between base 316 and cover 318. The heat shrink tubing 330, which is similar to that described above, helps support the electronic tag 314 within the base 316. Similar to the embodiments shown above with respect to FIGS. 1-9, base 316 includes a pair of opposed curved edges 332 which help shape the shrink tube about the base 316. Inward of one curved edge 332 is a longitudinal upwardly opening U-shaped depression 340. Depression 340 underlies tube 330 and forms a cut slot. The cut slot allows for insertion of a scissor or the blade of a cutting tool so as to cut the heat shrunk tube 330, thereby removing the tag from the article on which it is placed.

An undersurface 317 of base 316 may include thereon a pad 321 formed of a soft thermoplastic (TPE) material. The pad is similar to that described above with respect to the embodiments of FIGS. 16-25. The pad 321 may be secured to base 316 during the molding process or may be separately secured thereto by an appropriate adhesive. The TPE pad 321 helps secure the housing 310 to the temple piece 385 of eyeglasses 380.

Figure 27:
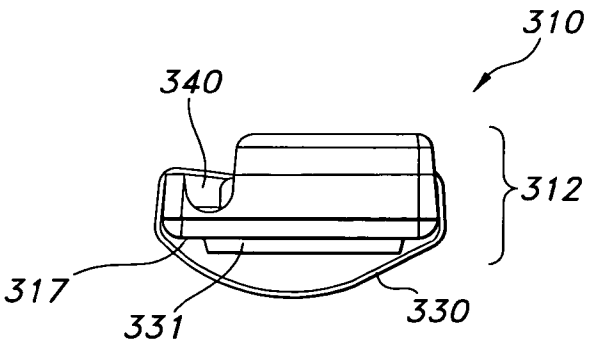
FIG. 27 is an assembled end view of the electronic tag assembly of FIG. 26.
Figure 29:
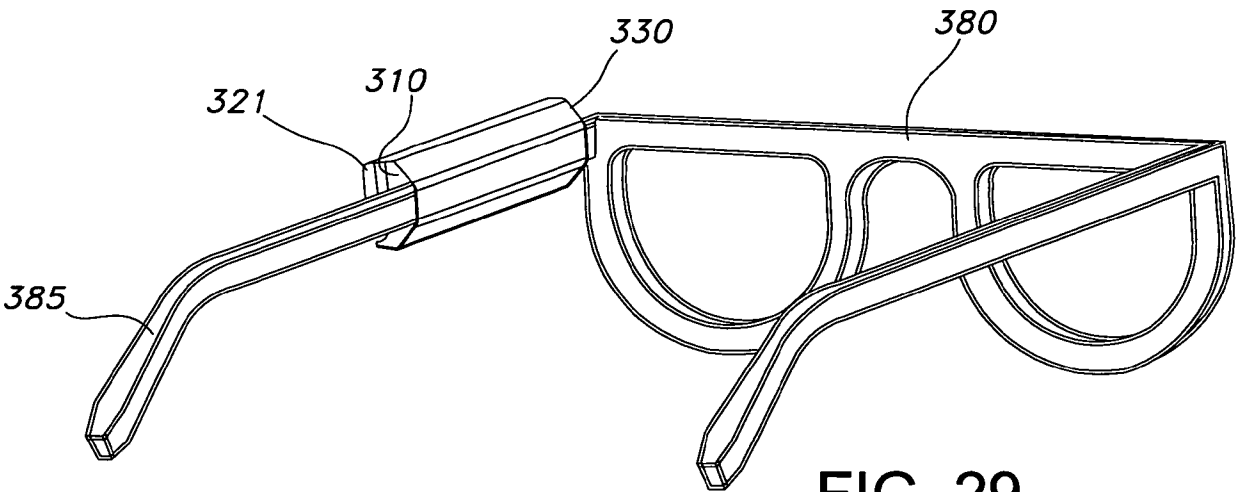
FIG. 29 shows the electronic tag assembly of FIG. 26 attached to the temple piece of the eyeglasses.

As shown in FIG. 29, the tag housing assembly 310, including the tube 330, is formed as shown in FIG. 27. It is secured over the temple piece 385 of eyeglasses 380 by inserting the temple piece into the space defined between the TPE pad 321 and the tube 330. Shrink tube 330 is then shrunk onto the temple piece 385 by applying heat thereto. The shrinking of the tube forces the temple piece 385 into a resilient engagement with the TPE pad 321. Such resilient engagement provides a secure attachment by conforming the TPE pad and the shrink tube to the temple piece. Moreover, the TPE material provides a frictional surface which resists sliding of the assembly along the temple piece preventing unauthorized removal. After purchase, the tag housing may be removed by cutting the shrink tube 330 at the U-shaped depression 340.

Various changes to the foregoing described and shown structures would now be evident to those skilled in the art. Accordingly, the particularly disclosed scope of the invention is set forth in the following claims.

What is claimed is:

1. An electronic tag assembly comprising:

a tag housing including a base and a cover attachable to said base and defining a tag receiving cavity;

an electronic tag supported within said cavity; and a heat shrinkable tube supported on said housing and surrounding said base for attaching said assembly to an article using said heat shrinkable tube.

2. The electronic tag assembly of claim 1 wherein said base includes a planar portion including said cavity.

3. The electronic tag assembly of claim 2 wherein said housing having a pair of opposed ends and an elongated section extending therebetween, said ends extend outwardly from said tube.

4. The electronic tag assembly of claim 3 wherein said ends remains uncovered by said tube.

5. The electronic tag assembly of claim 4 wherein said ends are wider then said elongated section, said end extend beyond said elongated section.

6. The electronic tag assembly of claim 1 wherein said base includes an inner surface and an outer surface, said inner surface is coextensive with said electronic tag and said outer surface includes a padded adhesive strip attached thereto for protecting articles attached to said assembly.

7. The electronic tag assembly of claim 5 said ends includes at least one recess to allow said tube to recess therein.

8. The electronic tag assembly of claim 7 wherein said cover supports an indicia bearing structure.

* * * * *